United States Patent [19]

Delaplace et al.

[11] Patent Number: 4,759,505

[45] Date of Patent: Jul. 26, 1988

[54] FLAME SPRAY TORCH FOR THE MANUFACTURING OF SURFACE LAYERS ON WORKPIECES

[75] Inventors: Philippe Delaplace, Lausanne; Hans-Theo Steine, Chavannes, both of Switzerland

[73] Assignee: Castolin S.A., Saint-Sulpice, Switzerland

[21] Appl. No.: 921,328

[22] Filed: Oct. 21, 1986

[30] Foreign Application Priority Data

Oct. 22, 1985 [CH] Switzerland ..... 4540/85

[51] Int. Cl.[4] ..... B05B 1/00

[52] U.S. Cl. ..... 239/85; 239/600

[58] Field of Search ..... 239/83, 85, 79, 433, 239/434, 390, 396, 397, 600, 336; 219/121 PM, 121 PQ, 76.16, 74

[56] References Cited

U.S. PATENT DOCUMENTS

| | | | |
|---|---|---|---|
| 3,190,560 | 6/1965 | Schilling et al. | 239/85 |
| 3,415,449 | 12/1968 | Hawk | 239/85 |
| 3,476,320 | 11/1969 | Fleischhacker et al. | 239/85 |
| 4,317,540 | 3/1982 | Simm et al. | 239/85 |
| 4,598,871 | 7/1986 | Hartle | 239/390 |

*Primary Examiner*—Andres Kashnikow
*Assistant Examiner*—Karen B. Merritt
*Attorney, Agent, or Firm*—Hopgood, Calimafde, Kalil, Blaustein & Judlowe

[57] ABSTRACT

A flame spray torch for the manufacturing of surface layers on workpieces by spraying thereon powdered materials is provided. The flame spray torch comprises a torch body with respective conveying ducts for oxygen, for a combustion gas and for a powder-carrier gas mixture, including an outlet opening in the torch body for the powder-carrier gas mixture. The torch also has a powder supply duct extending in the torch body, an insert part in the conveying duct for the powder-carrier gas mixture capable of being inserted therein from the outlet opening, the outlet opening communicating with the powder supply duct. An axial inlet opening is provided in the torch body communicating with the inlet opening of the insert part through an extension duct. The extension duct has a lateral opening which communicates with the oxygen conveying duct of the torch body through a regulating device, the inlet opening of the insert part being adapted for exchangeably receiving either an injector part or a closing member for the lateral opening thereof. The inlet opening of the torch body is adapted for exchangeably receiving either a closing member or a guiding member for a powder-carrier gas mixture or a carrier gas guiding member with a lateral inlet passage for oxygen arranged for communicating with the lateral opening in the extension duct.

5 Claims, 1 Drawing Sheet

FLAME SPRAY TORCH FOR THE MANUFACTURING OF SURFACE LAYERS ON WORKPIECES

The present invention relates to a flame spray torch for the manufacturing of surface layers on workpieces by spraying thereon powdered materials, in accordance with the pre-characterizing clause of patent claim 1.

BACKGROUND OF THE INVENTION

The known flame spray torches of this kind are generally very limited in their possiblities of application and frequently they do not provide a sufficient safety of operation.

An object of the invention is to create a flame spray torch which can be used on one hand as a manual torch with a powder container mounted thereon and on the other hand by simple exchange of members accessible from outside as an automatically working machine torch, as well as to render such a torch in a simple way adaptable to various power levels and various working conditions. In particular operation should be possible selectively with oxygen as carrier gas for the spray powder or with a carrier-gas separately supplied from outside and with variable addition of oxygen.

This is achieved according to the invention by the features indicated in the claims.

Further features and properties of the flame spray torch of the invention become apparent from the following description of an example of an embodiment which is represented in the attached drawing.

THE INVENTION

Figure 1:
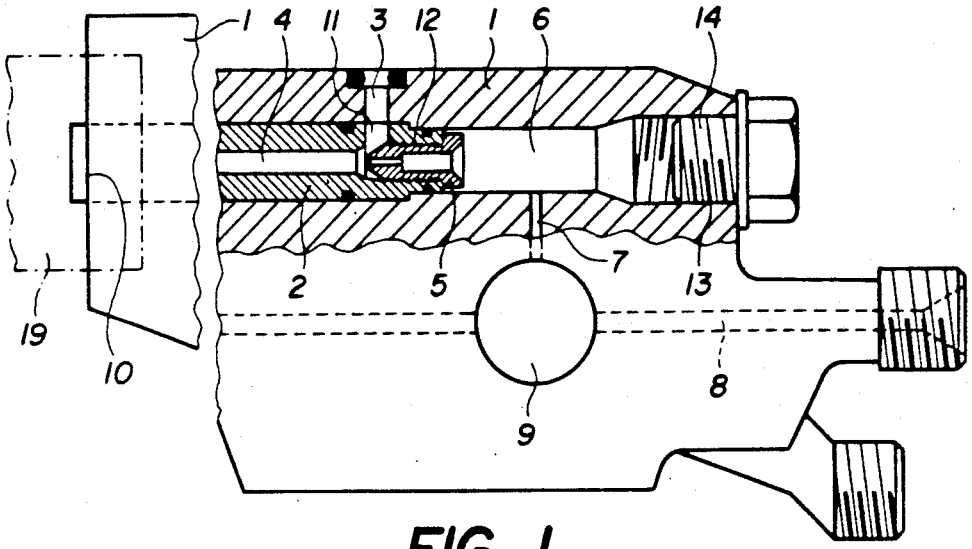
FIG. 1 shows a lateral view, partly insection, of a torch body for the flame spray torch according to the invention.

The torch body 1 shown in FIG. 1 is adapted on one of its ends for connection to a nozzle part 19 not represented in detail and indicated by interrupted lines, and it has on its opposite end connections for oxygen and a combustion gas which are guided in corresponding conveying ducts of which the oxygen conveying duct 8 is indicated by interrupted lines, through at least one regulating device—such as the schematically shown regulating valve 9—across the torch body to the nozzle part 19.

Furthermore, the torch body has a conveying duct 4 for a powder-carrier gas mixture, which duct extends in the present torch through an insert part 2 which can be inserted in the torch body when the nozzle part is taken away, from outside, from an outlet opening 10 situated downstream. Opposite the conveying duct 4 the insert part 2 has an inlet opening 12 which is provided with a screw thread and can be screwed for example as shown in FIG. 1 into an injector part 5. The insert part 2 further has a lateral inlet opening 11 which communicates with a powder supply duct 3 provided in the torch body and joins the conveying duct 4 whereby a mixing chamber is formed at the outlet of the injector part 5. An extension part 6 is provided as extension of the conveying duct 4 formed as a cylindrical bore, which extension duct joins an inlet opening 13 of the torch body. This inlet opening also has a threaded portion into which a closing member 14 of the extension duct is screwed according to FIG. 1 for example.

The extension duct 6 further has a lateral opening 7 which communicates with the oxygen conveying channel 8 of the torch body. Oxygen is used in the case of FIG. 1 as a carrier gas and reaches through the extension duct 6 the injector part 5 in which an acceleration is obtained by bores of reduced diameter and to which a spraying material in powder form is conveyed through the duct 3 and the opening 11 of the insert part from a powder container which is not represented. This material is conveyed in the conveying duct 4 as a powder gas mixture towards the nozzle part. This is an example of a manual operation of the flame spray torch.

Figure 2:
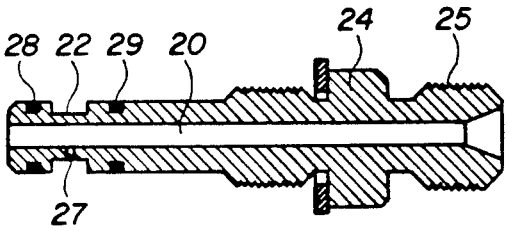
FIG. 2 shows an axial section through a guiding member for the carrier gas to be selectively inserted in the torch body.

FIG. 2 shows a guiding member 24 for the carrier gas, which guiding member can be screwed into the inlet opening 13 of the torch body in place of the closing part 14 and which is adapted for connection to an external carrier gas source. The part 24 has a central duct 20 extending from end to end and connecting a connecting part 25 for fitting a carrier gas conduit, to the outlet end of the guiding member 24, which outlet end is placed opposite the injector part 5. At the height of the lateral opening 7 of the extension duct 6 an inlet duct 27 is provided in the guiding member 24, the corresponding wall section 22 of the guiding member being to this effect formed as ring-shaped groove to guarantee in each angular position of the guiding member a communication with the lateral opening 7. O-rings 28 and 29 are arranged on either side of this groove to render it tight with respect to the extension duct 6.

When using a guiding member according to FIG. 2, the injector part 5 is supplied on one hand with a carrier gas such as argon and on the other hand with oxygen from the conveying duct 8 for drawing spray powder out of the mentioned powder container mounted on the torch. In this case it is preferred to lead a residual flow of oxygen through the injector after the switching-off of the torch in operation, as a safeguard against a back diffusion of the combustion gas. In the case that, due to the property of the powder, oxygen is not to be used as carrier gas or part of the carrier gas, a guding member of similar shape as the one of FIG. 2 without inlet passage 27 is used in place of the guiding member of FIG. 2, the lateral opening 7 being thus closed by the guiding member 24 and only the externally supplied carrier gas is effective.

Figure 3:
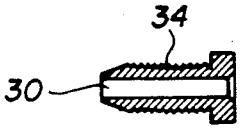
FIG. 3 shows an axial section through a closing member to be selectively inserted.

FIG. 3 shows a closing member 34 which can be screwed into the corresponding opening of the insert part 2 in place of the injector part 5 and which, in the screwed-in position closes the lateral opening 11 against the conveying duct 4, while the end of the member 34 is introduced into the opening of duct 4 or is applied against the same.

Figure 4:
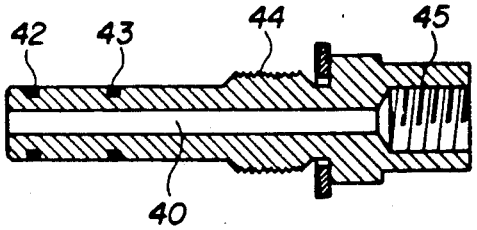
FIG. 4 shows an axial section through a powder-carrier gas guiding member also for selective insertion in the torch body of FIG. 1.

FIG. 4 shows a guiding member 44 which can be screwed into the torch body 1 in place of the guiding member 24 or the closing member 14 and which is used together with the closing member of FIG. 3. The guiding member 44 has a central duct 40 which is an extension of the central duct 30 of the closing member 34 and the outer end 45 of which is adapted for connection to an external source of a powder-carrier gas mixture. The portion of this guiding member which is opposite the lateral opening 7 in the screwed-in poistion of member 44 can be provided either, as shown in FIG. 4, with O-rings 42, 43 for closing the opening 7 against duct 6 or it can have a corresponding lateral inlet passage as shown in FIG. 2 allowing the addition of oxygen to the powder carrier gas mixture or allowing a flow of oxygen after shutting-off of the torch as a safeguard against diffusing back of the combustion gas.

When using the closing and guiding members according to FIGS. 3 and 4, the present flame spray torch serves as a machine torch supplied from an external powder feeding device independent of the torch.

The above described embodiment illustrates the manifold of possibilities of using the flame spray torch according to the invention, while the versatility in its application and the safety of operation which result in particular from the adjustable flow of oxygen respectively as carrier gas, the addition to the carrier gas and/or as after-flowing gas are of decisive importance.

What is claimed is:

1. A flame spray torch for the manufacturing of surface layers on workpieces by spraying thereon powdered materials, comprising a torch body with respective conveying ducts for oxygen, for a combustion gas and for a powder-carrier gas mixture, an outlet opening in said torch body for the powder-carrier gas mixture, a powder supply duct extending in said torch body, an insert part in said conveying duct for the powder-carrier gas mixture capable of being inserted therein from said outlet opening, said outlet opening communicating with said powder supply duct, an axial inlet opening in said torch body communicating with said inlet opening of the insert part through an extension duct, a lateral opening in said extension duct communicating with said oxygen conveying duct of the torch body through a regulating device, said inlet opening of the insert part being adapted for exchangeably receiving either an injector part or a closing member for said lateral opening thereof, and said inlet opening of the torch body being adapted for exchangeably receiving either a closing member or a guiding member for a powder-carrier gas mixture or a carrier gas guiding member with a lateral inlet passage for oxygen arranged for communicating with said lateral opening in said extension duct.

2. A flame spray torch in accordance with claim 1, wherein an injector part is arranged in said axial inlet opening of said insert part and a closing member is provided in said inlet opening of the torch body.

3. A flame spray torch in accordance with claim 1, wherein an injector part is arranged in said axial inlet opening of said insert part and a carrier gas guiding member is provided in said inlet opening of the torch body so as to extend into said extension duct, said carrier gas guiding member comprising a guide duct extending from end to end thereof, a connection part for connection to a carrier gas conduit and a wall part having said lateral inlet passage for oxygen.

4. A flame spray torch in accordance with claim 1, wherein a closing member is arranged in said inlet opening of said insert part so as to close said powder supply duct with respect to said powder-carrier gas conveying duct, said closing member having a through duct for connecting said powder-carrier gas conveying duct and said extension duct, and wherein a guiding member for a powder-carrier gas mixture supplied externally to the torch is arranged in said inlet opening of the torch body.

5. A flame spray torch in accordance with claim 4, wherein said powder-carrier gas guiding member has means for closing said lateral opening in said extension duct.

* * * * *